United States Patent [19]

Soranno et al.

[11] Patent Number: 4,781,754

[45] Date of Patent: Nov. 1, 1988

[54] RAPID SOLIDIFICATION OF PLASMA SPRAYED MAGNETIC ALLOYS

[75] Inventors: Vito W. Soranno, Sterling Heights; Frank G. Pirrallo, Troy; Thomas H. Van Steenkiste, Washington, all of Mich.

[73] Assignee: General Motors Corporation, Detroit, Mich.

[21] Appl. No.: 100,429

[22] Filed: Sep. 24, 1987

[51] Int. Cl.[4] ..... B22F 9/10

[52] U.S. Cl. ..... 75/0.5 B; 75/0.5 BA; 75/0.5 C; 264/8; 148/304; 148/305

[58] Field of Search ..... 75/0.5 B, 0.5 C, 0.5 BA; 264/8; 148/304, 305

[56] References Cited

U.S. PATENT DOCUMENTS

| | | | |
|---|---|---|---|
| 3,316,073 | 4/1967 | Kelso | 428/570 |
| 3,963,812 | 6/1976 | Schlienger | 75/0.5 C |
| 4,221,587 | 9/1980 | Ray | 75/0.5 C |

FOREIGN PATENT DOCUMENTS

| | | | |
|---|---|---|---|
| 0048652 | 3/1983 | Japan | 148/304 |

OTHER PUBLICATIONS

Savage et al.; Production of Rapidly Solidified Metals and Alloys; Journal of Metals; Apr. 1984; pp. 23, 26.

*Primary Examiner*—Wayland Stallard
*Attorney, Agent, or Firm*—Elizabeth F. Harasek

[57] ABSTRACT

A method is provided for rapidly solidifying rare earth-transition metal containing alloy. It entails introducing the alloy into the flame of a plasma torch and directing the torch flame onto the inside surface of a rotating quench cylinder. A non-oxidizing gas is also directed onto the quench surface so that the alloy solidifies at a rate such that a powder having a substantially amorphous to finely crystalline microstructure is obtained and such that the solidified alloy does not adhere to the quench surface and can be easily collected.

7 Claims, 2 Drawing Sheets

RAPID SOLIDIFICATION OF PLASMA SPRAYED MAGNETIC ALLOYS

This invention relates to an improved high yield process for rapidly solidifying rare earth-transition metal alloys. More particularly, the invention relates to a method of plasma spraying such alloys onto the interior walls of a rotating quench cylinder to form fine powder particles with a substantially amorphous to very finely crystalline microstructure.

BACKGROUND

The invention of high energy product rare earth-iron based permanent magnets has created a need for high yield, low cost processes for making them.

U.S. Pat. Nos. 4,496,395 and 414,936 (filed Sept. 3, 1982) and 544,728 (filed Oct. 26, 1983) all to Croat and assigned to General Motors Corporation relate to this new breed of rare earth-iron (RE-Fe) containing permanent magnets. The preferred magnet compositions contain the light rare earth-elements neodymium and/or praseodymium, the transition metal iron or mixtures of iron and cobalt, and boron in relative amounts such that a substantial amount of a magnetically hardenable $RE_2TM_{14}B$ phase is present.

A preferred method of making such magnets is to rapidly solidify molten alloy such that atomic ordering ranges in the solid are smaller than or about equal to optimum single magnetic domain size (about 400 nanometers). Further processing such as annealing, pressing and/or hot working as taught in the applications noted above and U.S. Pat. No. 520,170 (filed Aug. 4, 1983) to Lee, also assigned to General Motors Corporation, have produced RE-Fe-B magnets with energy products of about forty-five megaGaussOersteds.

One method of rapid solidification is jet casting or melt spinning. This method entails expressing molten alloy through a small orifice (about 0.025–0.05 in., 0.635–1.27 mm) onto the perimeter of a rapidly rotating chill wheel. The molten alloy quenches almost instantaneously to produce very thin, brittle, ribbons having the desired amorphous to very finely crystalline microstructure.

A problem with melt spinning is that the orifice tends to wear and get larger during long runs. Another problem is that a constant source of molten alloy is required to feed the jet casting tundish. It is also necessary to use fairly pure forms of the alloy to prevent plugging of the small ejection orifice with insoluble contaminants.

It was our principal object to find an alternate, high through-put method of rapidly solidifying rare earth-iron based alloys. One such method is plasma spray deposition which is described in the article "Production of Rapidly Solidified Metals and Alloys" by S. J. Savage and F. H. Froes, Journal of Metals, Apr. 1984, pages 20–33 at page 26.

A plasma gun or torch generally comprises a nonconsumable anode and a cathode. An electric arc is struck between the electrodes which ionizes a gas to form an ion plasma. Plasma spray deposition is a method wherein a liquid or powdered metal feedstock is injected into the plasma and is projected towards a substrate at high velocity. The projected metal deposits on the substrate. A layer about 0.1 mm thick may be deposited on each pass of the spray gun. As much as 10 lbs. or 4.5 kg. per hour can be processed through a 40 kWatt plasma torch. The through-put can be increased by using a higher power torch.

We have found that plasma deposition is not directly suited to the manufacture of rapidly solidified RE-Fe magnets other than thin films (less than about 0.2 mm) deposited on a heat conductive metal backing. Repeated passes of the plasma torch have a tendency to over-anneal (i.e., cause substantial crystal growth) in the material built up underneath. This problem is aggravated because RE-Fe compositions are not very good heat conductors and cannot transfer the heat generated by the torch out of the deposited alloy fast enough to create the desired substantially amorphous to finely crystalline microstructure. It was found that "cross blasting" or the process of blowing an inert gas jet transversely into the plasma spray enough pressure to divert the plasma jet without solidifying the molten feedstock droplets or changing their trajectory did not solve the problem of underquenching (over-annealing).

BRIEF SUMMARY

In accordance with a preferred embodiment, a plasma torch is located in a controlled atmosphere chamber containing a non-oxidizing atmosphere. An arc is struck between the anode and cathode of the torch and a plasma of an arc gas such as a 4:1 mixture of argon to helium is generated. An amount of arc gas sufficient to maintain the plasma is continuously delivered to the torch.

After the plasma is generated, small particles of RE-Fe containing alloy are carried into the plasma in a stream of an inert gas such as argon. The particles immediately melt in the high temperature plasma and are accelerated in the flame to a velocity of about 400 m/sec.

The plasma flame is directed towards the interior wall of a thermally conductive quench cylinder that is rapidly rotated about its central axis. A small stream of inert gas, preferably liquefied, is continuously directed towards the interior wall of the cylinder at a location where it does not interfere with the flame from the plasma torch.

The rotation of the quench cylinder creates a thin layer of cold gas and/or fluid adjacent its interior wall. Molten alloy particles are propelled through this layer, splat quench against the wall, are held there momentarily by centrifugal force, fall of the -wall and are collected. The presence of the cold fluid layer promotes solidification of the alloy particles rapidly enough to create the substantially amorphous to finely crystalline microstructure desirable for magnet manufacture from the as-quenched powder.

Moreover, the cold fluid continuously cools the quench surface of the cylinder to prevent excessive heating and unacceptable reduced quench rates. It also lubricates the quench surface to prevent adhesion of the hot, high velocity alloy particles. These features allow the plasma spray quench process to be run continuously. They also make it possible to use high power plasma torches with output capacities of a hundred pounds per hour or more. The product of the plasma spray quench process is a fine powder with a very fine grain microstructure which may be bonded, pressed or hot-formed into magnet shapes.

DETAILED DESCRIPTION

The invention may be better understood in view of the several Figures, the Examples and the Discussion which follow.

Figure 1:
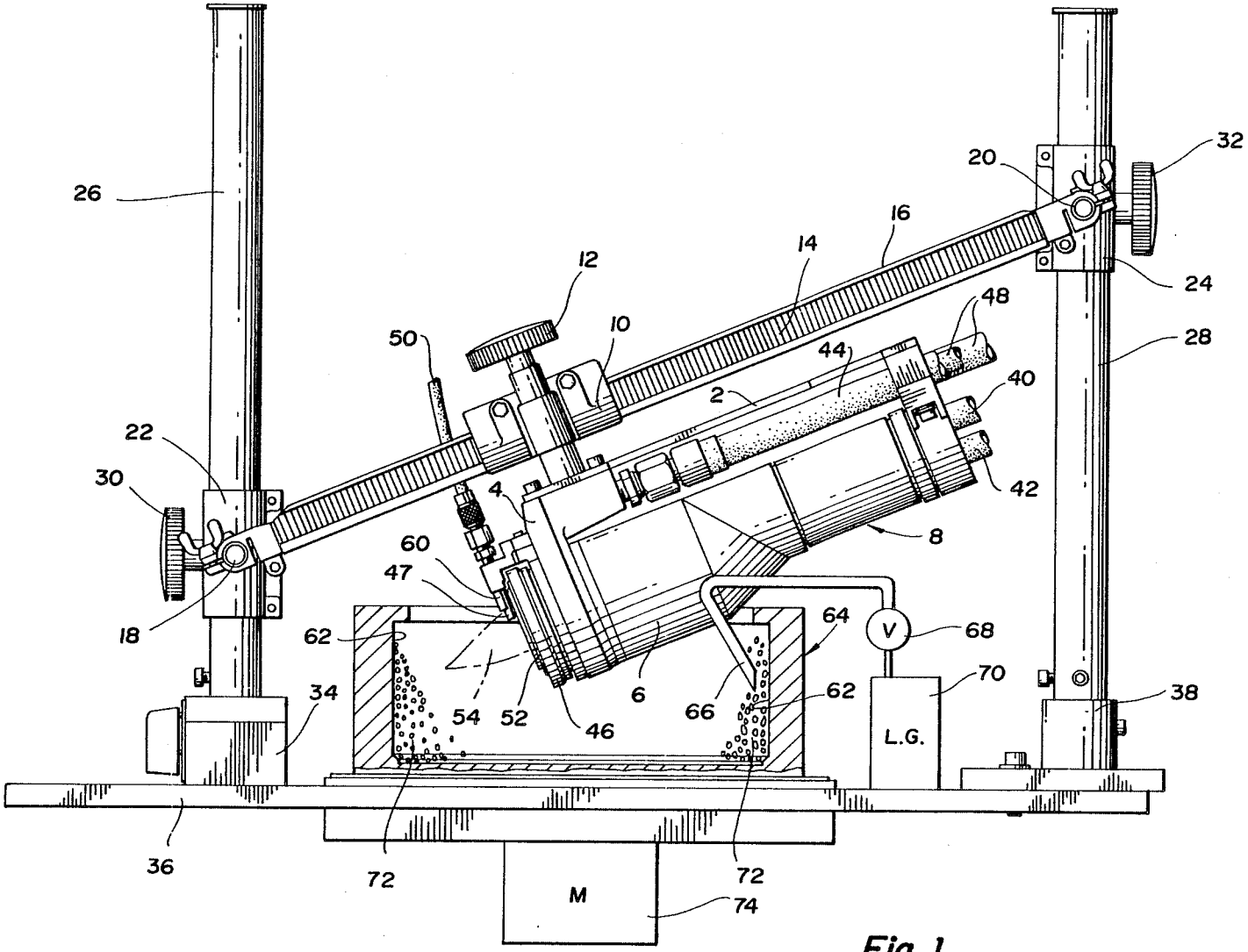
FIG. 1 is a schematic representation of a controlled atmosphere chamber in which RE-TM powder and a liquefied gas are sprayed onto the interior surface of a rotating quench cylinder to make rapidly solidified flakes.

In accordance with a preferred practice of the invention and with respect to FIG. 1, plate 2 is bolted onto collar 4 which surrounds body 6 of a plasma torch 8. The plate is fastened to slider 10 in which a pinion gear (not shown) is located so that turning knob 12 causes the slider to travel along a rack 14 on cross member 16. Ends 18 and 20 of cross member 16 are pivotably mounted on vertical sliders 22 and 24. The vertical sliders can be moved by loosening knobs 30 and 32 at the ends of tightening bolts (not shown). Base 34 of vertical support 26 can be a permanent magnet so that it can be moved and maintained at a desired location on mild steel floor 36 of a plasma spray chamber. Vertical support 28 pivots in base 38. Plasma torch 8 is located where desired by adjusting knobs 12, 30, 32 and base 34.

Plasma torch is provided with power cables 40 and 42 which are hooked-up to a suitable power supply. The positively charged nozzle 46 and electrode 47 generate an arc for striking the plasma between them. Tube 44, for carrying gas for generating a plasma arc, is brought into the torch nozzle 46. Coolant fluid carrying lines 48 are also hooked up to flow in the nozzle. Tube 50 is provided for injecting RE-TM particles into plasma 54. Particle feed tube 60 is located at a distance from the nozzle outlet 52 so that 20 the particles are injected into the desired portion of the plasma torch flame.

Torch 8 is operated by turning on the power, running coolant such as cold water through cooling lines 48, generating a gas plasma 54 and injecting RE-TM particles through tube 60. Suitable operational parameters will be set forth below.

The subject invention relates particularly to impinging molten particles of RE-TM composition from a plasma flame onto the interior surface 62 of a rotating quench cylinder 64. A cryogenic gas is emitted through delivery tube 66 through valve 68 from liquefied gas source 70. This forms a cold gas layer immediately adjacent interior surface 62. It is preferred to use a relatively heavy, inert gas such as argon to prevent reaction between it and the RE-TM alloy and so that centrifugal force generated by rotating quench cylinder keeps a layer of the gas adjacent interior surface. The presence of the gas layer improves the rapid solidification process by encouraging heat transfer of the particles to the quench cylinder by constantly cooling it and by preventing adhesion of plasma sprayed, splat quenched particles 72 to it. It also provides for easy collection of the particles.

Quench cylinder may be rotated by an air driven motor 74. Means, not shown, may be provided for continuously emptying splat quenched particles. The entire plasma spray process should be conducted in a non-oxidizing atmosphere. This may be accomplished by retaining the torch and quench wheel in a sealed atmosphere controlled chamber.

Figure 2:
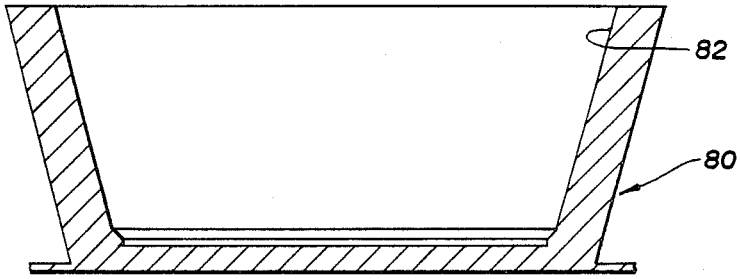
FIGS. 2 and 3 are cross-sectional views of alternate quench cylinder designs.
Figure 3:
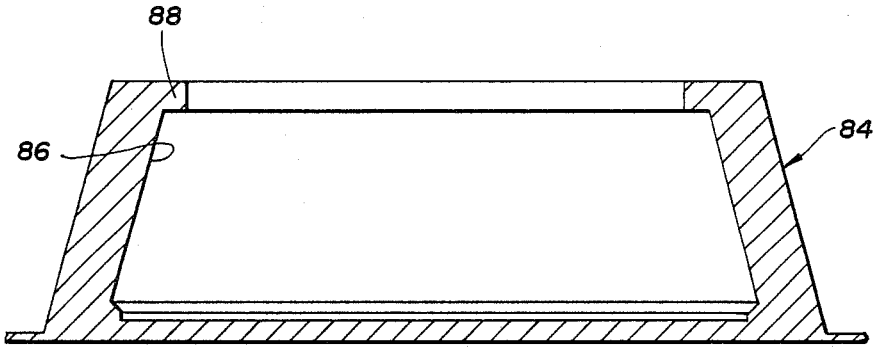

The quench cylinder of FIG. 1 has vertical walls and an overhanging lip. We have obtained our best results using a solid copper cylinder although other metals are also suitable. FIG. 2 shows another suitable quench cylinder 80 which has outwardly sloping walls. Flakes quenched in such a cylinder would tend to ride up the walls and fall over the sides. FIG. 3 shows a quench cylinder 84 with inwardly sloping walls 86 and an overhanging 88. Flakes quenched in such a cylinder would tend to remain inside the cylinder and collect along the bottom edges.

During a run, processing variables can be adjusted to obtain optimum results. These include power level to the torch, powder feed rate, quench cylinder revolution rate, cooling gas/liquid flow rate, plasma gas composition, distance of the torch nozzle from the quench surface, angle of the plasma flame with respect to the quench surface, chamber atmosphere, nozzle coolant flow rate, etc. One skilled in the art can easily adjust such parameters, particularly in view of the following specific example.

EXAMPLE

A Metco TM, Inc. 10 MB plasma spray gun was installed in a vacuum chamber roughly as shown in FIG. 1. The torch has a maximum power output of 80 kWatt and particle emission speed of about mach 2. solid right circle cylindrical copper quench cylinder, 26 cm inside diameter, 6.35 mm thick, and 10.2 cm high, was rotatably mounted above the floor of the chamber. The cylinder could be rotated at a maximum velocity of 1000 revolutions per minute by means of a variable displacement hydraulic motor.

The chamber was pumped down to a vacuum of $5\times10^{-6}$ torr and then backfilled to just over 1 atmosphere with dry argon gas. Chamber pressure was maintained by venting argon from the chamber to atmosphere during a run, but the gas could be recycled if desired. Cold water was run through the torch nozzle. Dry helium and argon gas were delivered to the nozzle at rates of 100 and 50 cfh, respectively. The torch was operated at 48 kWatt and the nozzle was located about 7 inches from the quench surface. Particles of 325 mesh $Nd_{.13}(Fe_{0.95}B_{0.05})_{87}$ alloy were carried into the plasma in argon gas at a delivery rate of about 20#/hr. The plasma was directed at an angle of about 30° with respect to the vertical. Liquefied argon gas was delivered through a flexible copper tube at a pressure of 100 psi and a rate of 3#/min. The tube outlet was aimed at the quench surface of the rotating cylinder, about half-way up.

The grain size of the crystals was less than about 50 nanometers. The average particle size of the quenched, pancake-shaped particles was about 100–500 μm. Since these particles had smaller than optimum domain sized grains (about 400 nanometers), they were annealed to cause grain growth. They exhibited permanent magnetic properties which were not as good as those reported for melt-spun material but understandable in view of corrosion of the plasma sprayed powder caused by excess oxygen and water in the spray chamber.

A significant advantage of the plasma spray quench method described herein is that the equipment can be easily started and stopped without long lead times to melt alloy ingots. Furthermore, the process is less sensitive to impurities in the stock alloy.

While my invention has been described in terms of specific embodiments thereof, other forms may be readily adapted by those skilled in the art. Therefore, our invention is to be limited only in accordance with the following claims.

The embodiments of the invention in which an exclusive property or privilege is claimed are defined as follows:

1. A method of making rapidly solidified metal powder comprising the steps of introducing a said metal into the flame of a plasma torch; directing the torch flame onto the inside surface of a rotating quench cylinder to solidify the metal carried in the flame against said surface and continuously introducing a gas adjacent the inside surface of the rotating quench cylinder such that the metal carried in the torch flame is solidified against the inside surface of the cylinder at a rate such that a powder having a substantially amorphous to very finely crystalline microstructure is obtained and such that the solidified metal does not adhere to said inside surface of the quench cylinder.

2. The method of claim 1 wherein the surface of the quench cylinder slopes outwardly from bottom to top.

3. The method of claim 1 where the surface of the quench cylinder slopes inwardly from bottom to top.

4. A method of rapidly solidifying rare earth-transition metal containing alloy comprising the steps of introducing said alloy into the flame of a plasma torch; directing the torch flame onto the inside surface of a rotating quench cylinder to solidify the alloy carried in the flame against said surface and continuously introducing a non-oxidizing gas adjacent the inside surface of the rotating quench cylinder such that the alloy carried in the torch flame is solidified against the inside surface of the cylinder at a rate such that a powder having a substantially amorphous to very finely crystalline microstructure is obtained and such that the solidified alloy does not adhere to said inside surface of the quench cylinder.

5. The method of claim 4 where the surface of the rotating quench cylinder slopes outwardly from bottom to top.

6. The method of claim 4 where the surface of the quench cylinder slopes inwardly from bottom to top.

7. A method of rapidly solidifying a praseodymium and/or neodymium-iron-boron containing alloy preparatory to the manufacture of a permanent magnet therefrom comprising the steps of introducing a powder of said alloy into the flame of a plasma torch; melting said powder in said flame; directing the torch flame onto the inside surface of a rotating quench cylinder to solidify the molten alloy carried in the flame against said surface and continuously introducing a non-oxidizing gas adjacent the inside surface of the rotating quench cylinder such that the neodymium-iron-boron containing alloy carried in the torch flame is solidified against the inside surface of the cylinder at a rate such that a powder having a substantially amorphous to very finely crystalline microstructure is obtained and such that the solidified alloy does not adhere to said inside surface of the quench cylinder.

* * * * *